US007796090B2

(12) United States Patent
Minard et al.

(10) Patent No.: US 7,796,090 B2
(45) Date of Patent: Sep. 14, 2010

(54) COMPACT MULTIBAND ANTENNA

(75) Inventors: Philippe Minard, Saint Medard sur Ille (FR); Jean-François Pintos, Bourgbarre (FR); Ali Louzir, Rennes (FR); Philippe Gilberton, Geveze (FR)

(73) Assignee: Thomson Licensing, Boulogne-Billancourt (FR)

( * ) Notice: Subject to any disclaimer, the term of this patent is extended or adjusted under 35 U.S.C. 154(b) by 387 days.

(21) Appl. No.: 11/991,521

(22) PCT Filed: Aug. 31, 2006

(86) PCT No.: PCT/FR2006/050828

§ 371 (c)(1),
(2), (4) Date: Mar. 5, 2008

(87) PCT Pub. No.: WO2007/028918

PCT Pub. Date: Mar. 15, 2007

(65) Prior Publication Data

US 2009/0135075 A1 May 28, 2009

(30) Foreign Application Priority Data

Sep. 7, 2005 (FR) ..... 05 52697
Oct. 3, 2005 (FR) ..... 05 52987

(51) Int. Cl.
*H01Q 21/00* (2006.01)
*H01Q 1/24* (2006.01)

(52) U.S. Cl. ..... 343/727; 343/702; 343/725

(58) Field of Classification Search ..... 343/727, 343/725, 702, 726, 846, 767, 795
See application file for complete search history.

(56) References Cited

U.S. PATENT DOCUMENTS

| | | | | |
|---|---|---|---|---|
| 5,608,413 | A | 3/1997 | Macdonald | |
| 6,466,176 | B1 * | 10/2002 | Maoz et al. | 343/767 |
| 6,870,513 | B2 | 3/2005 | Deng et al. | |
| 6,940,460 | B2 * | 9/2005 | Maoz et al. | 343/702 |
| 7,362,283 | B2 * | 4/2008 | Quintero Illera et al. | 343/846 |
| 2003/0112200 | A1 * | 6/2003 | Marino | 343/824 |

FOREIGN PATENT DOCUMENTS

WO WO 02/05384 1/2002

OTHER PUBLICATIONS

Search Report Dated Feb. 7, 2007.

* cited by examiner

*Primary Examiner*—HoangAnh T Le
(74) *Attorney, Agent, or Firm*—Robert D. Shedd; Jeffrey M. Navon

(57) ABSTRACT

The present invention relates to a compact multiband antenna constituted by a first dipole type element comprising a first conductive arm connected to a second conductive arm having the shape of a box, mounted on a ground plane, the first and the second arms being supplied differentially and a second element of the slot type realized on said ground plane in the extension of said second arm.

8 Claims, 4 Drawing Sheets

COMPACT MULTIBAND ANTENNA

This application claims the benefit, under 35 U.S.C. §365 of International Application PCT/FR2006/050828, filed Aug. 31, 2006, which was published in accordance with PCT Article 21(2) on Mar. 15, 2007 in French and which claims the benefit of French patent application No. 0552697, filed Sep. 7, 2005 and French patent application No. 0552987, filed Oct. 3, 2005.

The present invention relates to a compact multiband antenna, more particularly a compact antenna being able to be connected to a receiver of terrestrial digital television (TNT) signals in DVB-H format (Digital Video Broadcast Handheld), the receiver being able to be a portable device such as a PDA (Personal Digital Assistant).

Nowadays, reception on a PDA or similar portable device is possible owing to the fact of the computing power of the microprocessor that equips most of these devices. The DVB-H standard uses a new standard of digital compression for video called H264 and recommends placing this new image format intended for mobile applications either in the UHF band (band between 470 and 870 MHz) or in the L band (band around 1.5 GHz). Moreover, the mobile terminals above must also be able to communicate by using a cellular network of the GSM 900 type (Global System for Mobile communications 900 MHz). As a result, the UHF band covered must be limited by a selective filtering at the 470-700 MHz band.

The antennas capable of being used with this type of terminal must therefore be sufficiently compact and comply with the constraints mentioned above.

Hence, the invention consists in proposing a compact multiband antenna in the form of an accessory for PDA or mobile terminals that is wideband from the point of view of DVB-H reception, multiband to access the L band and filtering for the GSM part.

The purpose of the present invention is therefore a compact multiband antenna, characterized in that it is constituted by a dipole type element comprising a first conductive arm connected to a second conductive arm having the shape of a box mounted on a ground plane, the first and second arms being supplied differentially and a second element of the slot type realized on said ground plane in the extension of said second arm.

Preferably, to facilitate the use as accessory of a portable terminal, the first and second arms are mounted in rotation with respect to each other. Hence, it is possible to fold the first arm onto the second arm in such a manner to obtain a compact object that can easily be put into a pocket.

According to one embodiment of the present invention, the first conductive arm is planar with a triangular tapered part at the level of the connection with the second arm, the triangular tapered part extending by a rectangular or square part. The specific shape of the second arm enables a wide band operation to be obtained while maintaining a minimum size. In this manner, the antenna is suitable to cover the UHF band.

Moreover, the second conductive arm has the shape of a box whose dimensions are suitable for receiving an electronic card. Preferably, this electronic card is compatible with the DVB-H standard and it comprises at least the circuits enabling the video stream to be received and to be sent to the mobile terminal or PDA.

According to another characteristic of the present invention, the dipole type element is connected to an impedance matching circuit. This impedance matching circuit is optimised in such a manner that the transmission between the processing circuits of the video stream and the antenna are maximised. It is moreover dedicated to the low part of the UHF band, namely the 470 MHz to 700 MHz band and performs an additional filtering function for the GSM band, namely around 900 MHz.

Moreover, according to a preferential embodiment, the slot type element comprises two U-shaped slots mounted head to tail. Said two resonating slots are realised in the ground plane in the extension of the second conductive arm of the dipole type element. The resonating slots are dimensioned in such a manner to realise a correct impedance matching at the level of the antenna in the L band, namely between 1452 MHz and 1492 MHz for Europe and between 1670 MHz and 1675 MHz for the United States.

Other characteristics and advantages of the present invention will emerge upon reading the following description of a preferential embodiment, this description being made with reference to the drawings attached in the appendix, in which:

FIG. 1 respectively shows at A a top view and at B a perspective view of a compact multiband antenna in accordance with the present invention.

To simplify the description, in the figures the same elements have the same references.

A description will first be made with reference to FIGS. 1A and 1B of an embodiment of a compact multiband antenna in accordance with the present invention.

As shown more particularly in FIG. 1B, the antenna is constituted by a dipole type element 1 and a slot type element 2. The two functions are not placed next to each other but one inside the other. Use is made of the necessarily large size of the ground plane to be able to be efficient in the UHF band, so as to integrate slots that can impedance match the L band signal. The dipole type element comprises a first arm 10 of a planar form with a noticeably triangular tapered part 10*a* extending by a rectangular part 10*b*. This form was chosen for a minimum size, the tapered part of triangular shape being able to obtain the wideband operation sought after.

Figure 1:
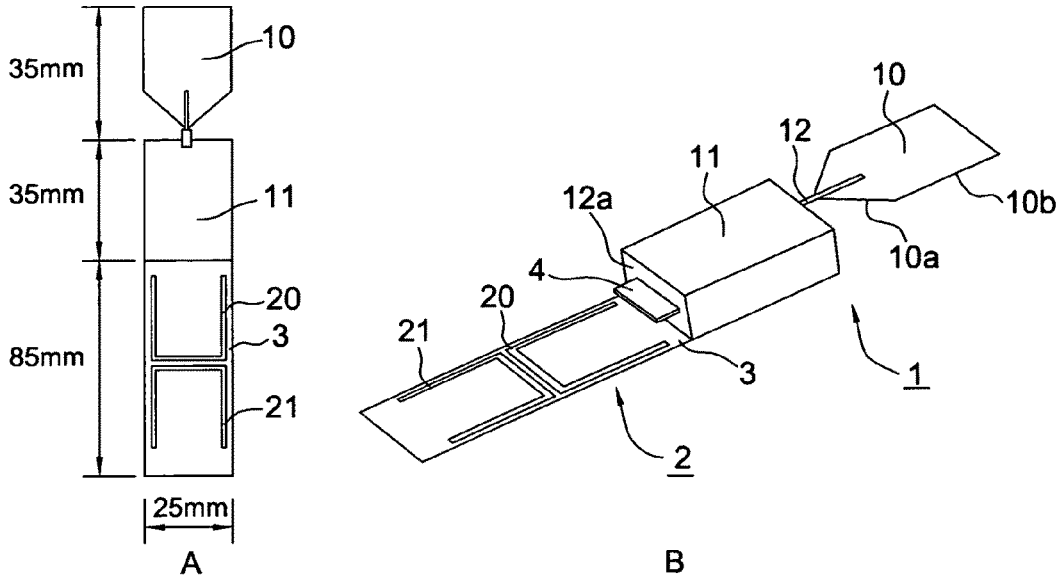

As shown in FIG. 1A, the part 10 is particularly compact with a total length of 35 mm and a width of 35 mm. This first arm 10 is connected to the level of the extremity of the triangular tapered part by a connection element 12 to the second arm 11 of the dipole. The second arm 11 has a volume shape, more particularly the shape of a rectangular or square box extended by a planar part into which the slots will be inserted. The first and second arms of the element 1 are made in a conductive material, namely in metal or using a metallized material. As shown in FIG. 1A, the second arm 11 also has a volume shaped part whose length is 35 mm, width 35 mm and thickness 16 mm, plus a planar part. The two arms 10 and 11 are mounted in rotation at the level of the axis 12, in such a manner as to be able to fold the arm 10 onto the arm 11 for transport. The antenna is in use mode when the arm 10 is unfolded, as shown in FIG. 1.

As shown in FIG. 1, the arm 11 is fixed on a ground plane 3. This ground plane can be for example, constituted by a conductive material, namely in metal or using a metallized material. Moreover, as shown in FIG. 1B, the antenna comprises a slot type element 2. In a more particular manner, two U-shaped slots 20, 21 mounted head to tail are realized on the metallized plane 3 in the extension of the arm 11. Said U-shaped slots are resonant slots and enable a correct impedance matching to be provided, namely a value for S 11 less than −10dB at the level of the antenna in the L band, namely in the band 1452 MHz at 1492 MHz for Europe or the 1670 MHz to 1675 MHz band for the United States.

In accordance with the present invention and as shown in FIG. 1B, the second arm 11 in box shape is dimensioned and realised to be able to receive an electronic card 4 on of whose extremities, namely the extremity projecting from the box 11 on FIG. 1B, can be inserted into a connector of a portable terminal such as a PDA or similar device.

Figure 2:
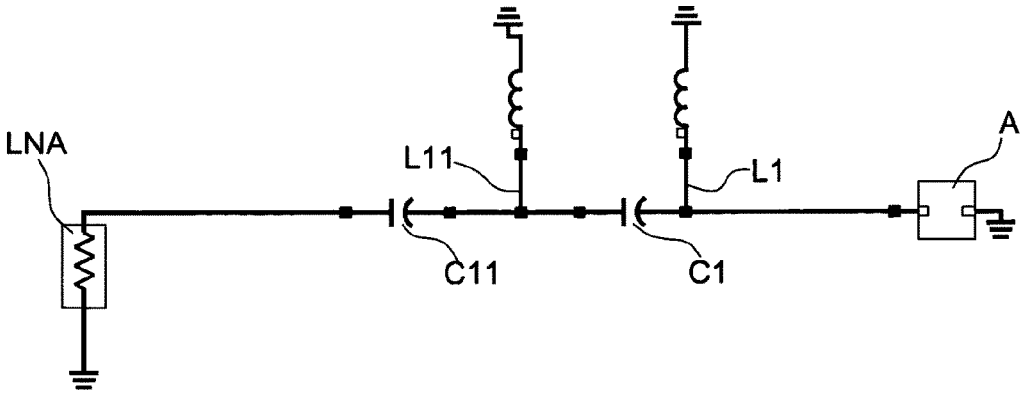
FIG. 2 represents an embodiment of the impedance matching circuit.

A description will now be made with reference to FIG. 2, of an embodiment of an impedance matching circuit that enables the transmission between the antenna A and the LNA (Low Noise Amplifier) to be maximised, namely the low noise amplifier provided at the input to the processing circuits of the video stream received by the antenna. This impedance matching circuit is connected to the antenna at the level of the connection point 12. It comprises, as shown in FIG. 2, two capacitors C1, C11 mounted in series between the connection point to the antenna A and the input of the LNA and two self-impedances L1, L11 connected respectively between the input point of the capacitor C1 and the ground for the self-impedance L1 and between the input point of the capacitor C11 and the ground for the self-impedance L11.

This impedance matching circuit was optimised to maximise the transmission between the LNA and the antenna in the bottom of the UHF band, namely between 470 MHz and 700 MHz, and to provide an additional filtering function for the GSM band around 900 MHz.

In the embodiment shown, the elements of the impedance matching circuit have the following values:

C1=2.22 pF, C11=12.4 pF, L1=19.8 nH and L11=10.8 nH.

A description will now be made with reference to FIG. 3 of an embodiment of an electronic card used within the framework of the present invention and being able to be inserted in the box formed by the arms 11 of the antenna. This electronic board 4 has a length between 70 and 80 mm and a width of 35 mm to adapt to said box. This electronic card thus comprises an LNA 40 connected to the antenna output, possibly via the impedance matching circuit described above. This circuit 40 is connected to a tuner 41 operating for the UHF bands and for the L band. The output of the tuner 41 is sent to a demodulator DVB-H 42. The output of the demodulator is sent to an SDIO interface (Secure Digital Input/Output) circuit 43. This interface enables the video stream to be sent to a portable terminal such as a PDA by means of an SDIO connector 44.

An antenna with its impedance matching circuit as described with reference to FIGS. 1 and 2 has been simulated. A circuit simulator ADS2004 was used to optimise the values and the choice of the impedance matching circuit to maximise the transmission between the antenna and the LNA. An electromagnetic simulator IE3D was used to provide the gain, efficiency curves and the radiation patterns as a function of the frequency for the antenna associated with its impedance matching circuit optimised on the previous software. The simulation provided the curves of FIGS. 4 to 7 as well as the radiation patterns of FIG. 8.

Figure 3:
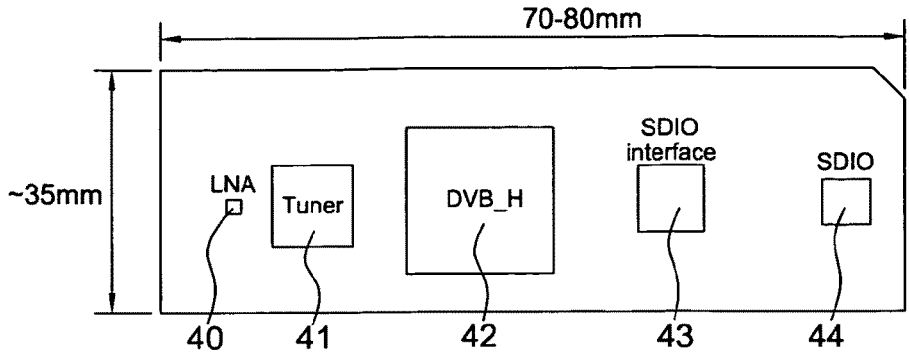
FIG. 3 is a diagrammatic view of an electronic card used with the antenna of the present invention.
Figure 4:
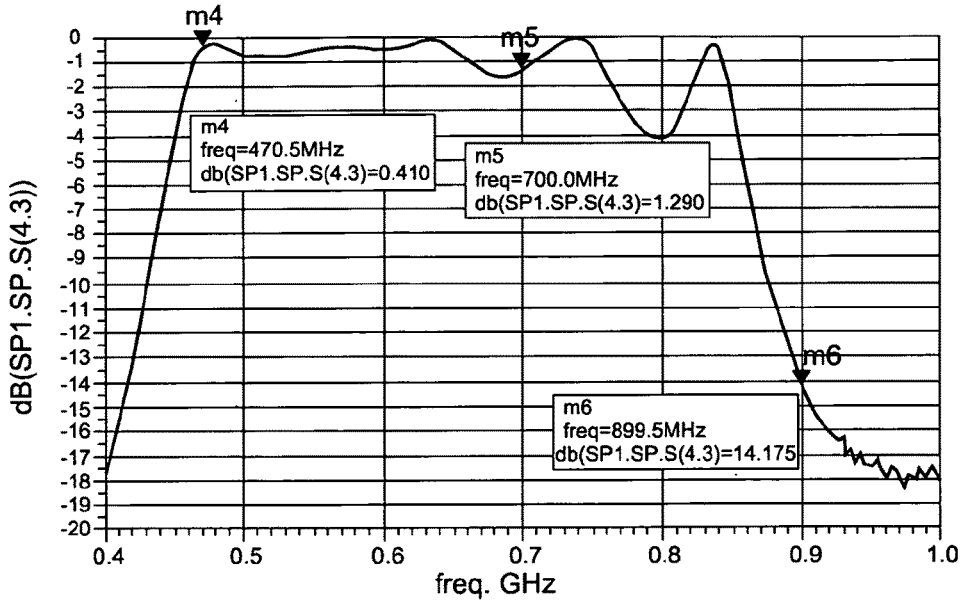
FIG. 4 shows a curve giving the transmission losses between the amplifier provided at the input of the electronic card and the antenna.

The curve of FIG. 4 gives the variations as a function of the frequency of the transmission losses between the antenna and the LNA of the electronic circuit of FIG. 3. It is seen that these losses are minimised and smoothed over the entire UHF band used with the DVB-H standard (namely between 470 MHz and 700 MHz). A large loss is however seen around 900 MHz, which shows that the impedance matching circuit performs a filtering function at this frequency.

Figure 5:
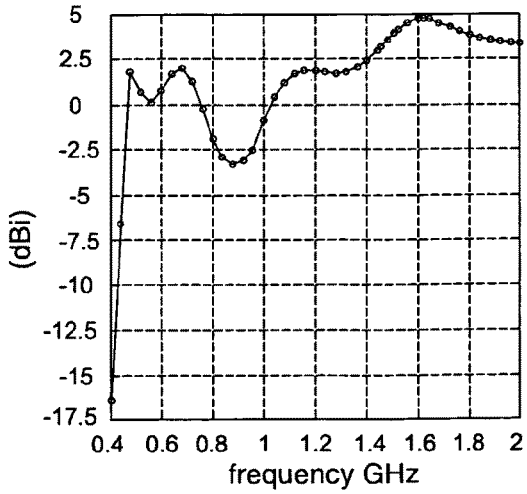
FIG. 5 is a curve giving the gain as a function of the frequency of an antenna in accordance with the present invention.

FIG. 5 shows the gain of the antenna as a function of the frequency. This curve confirms an operation being similar to a dipole in the UHF band (theoretically a dipole has a directivity of 2.17 dB) but more directive, in the L band. The gain curve approaches 5 dBi at 1.6 GHz, which is significant of a more directive radiation pattern. The directivity at 1.6 GHz can be explained by the fact of the placing in a network of two radiating slots whose patterns add together in a privileged direction.

Figure 6:
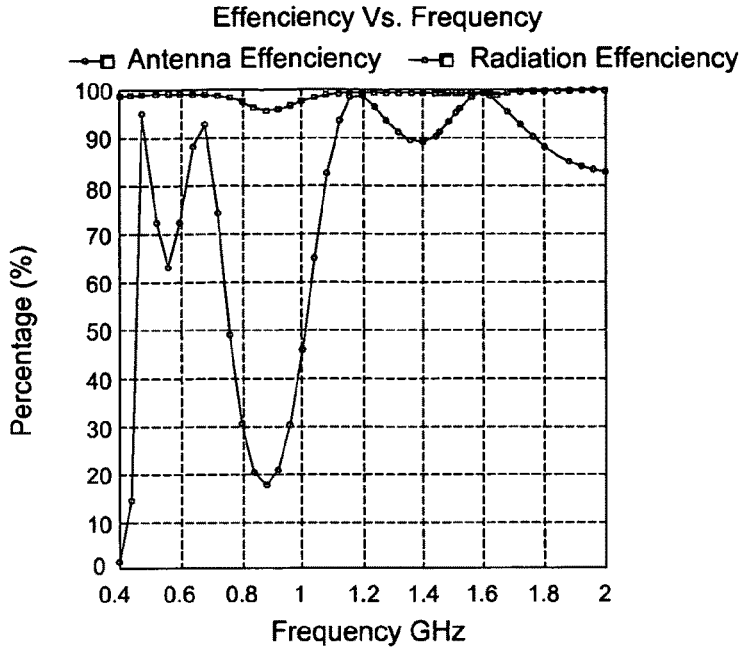
FIG. 6 is a curve giving the efficiency as a function of the frequency of the antenna of FIG. 1 with the impedance matching cells.

FIG. 6 shows the efficiency of the antenna system with an impedance matching cell as described with reference to FIG. 2. In this case, an antenna efficiency better than 60% is obtained over the entire UHF band of the DVB-H standard and better than 90% in the entire L band of the DVB-H standard (EP and US) but an efficiency less than 20% in the GSM band around 900 MHz. This therefore reflects a filtering function in the GSM band.

Figure 7:
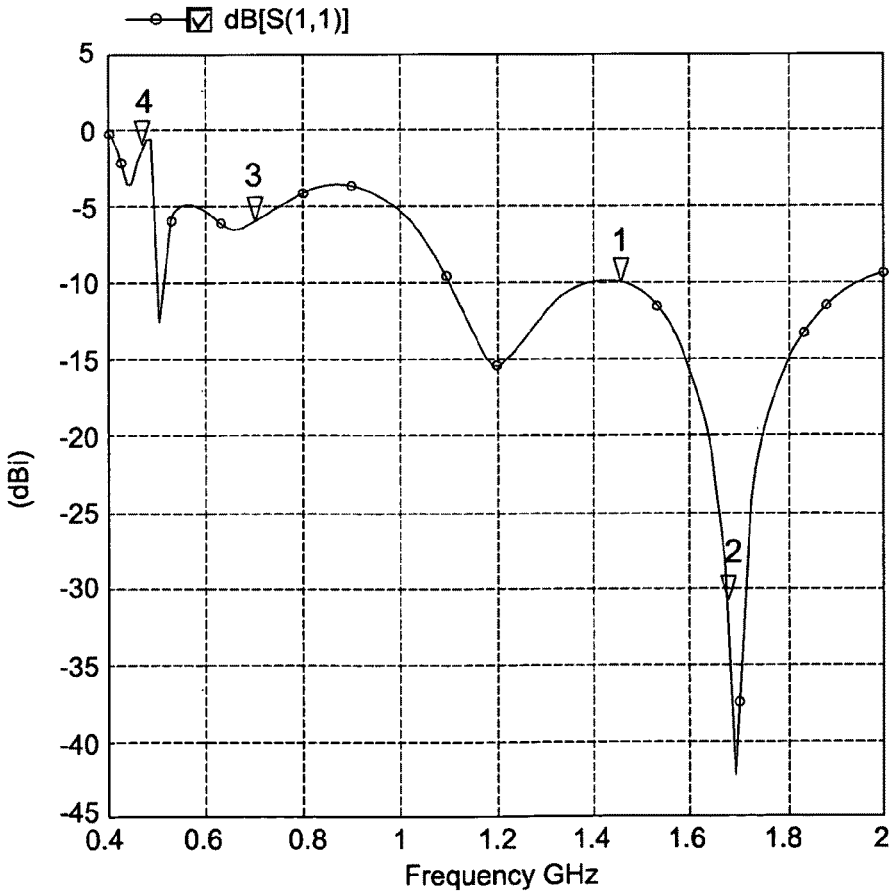
FIG. 7 is a curve giving the impedance matching of an antenna in accordance with the antenna of FIG. 1 up to 2 GHz charged on 50 ohms.

The FIG. 7 shows the impedance matching of the antenna up to 2 GHz, namely it provides the values of the S 11 parameters of the antenna and its impedance matching circuit beyond 1 GHz when it is charged on 50 ohms. An impedance matching less than −10dB in the L band is therefore obtained. This impedance matching is due to the resonance of the slots 20, 21 whose dimensions have been optimised on the position in the ground plane, on the length and width of the slots so as to cover both the European L band 1452-1492 MHz and the US L band 1670-1675 MHz.

Figure 8:
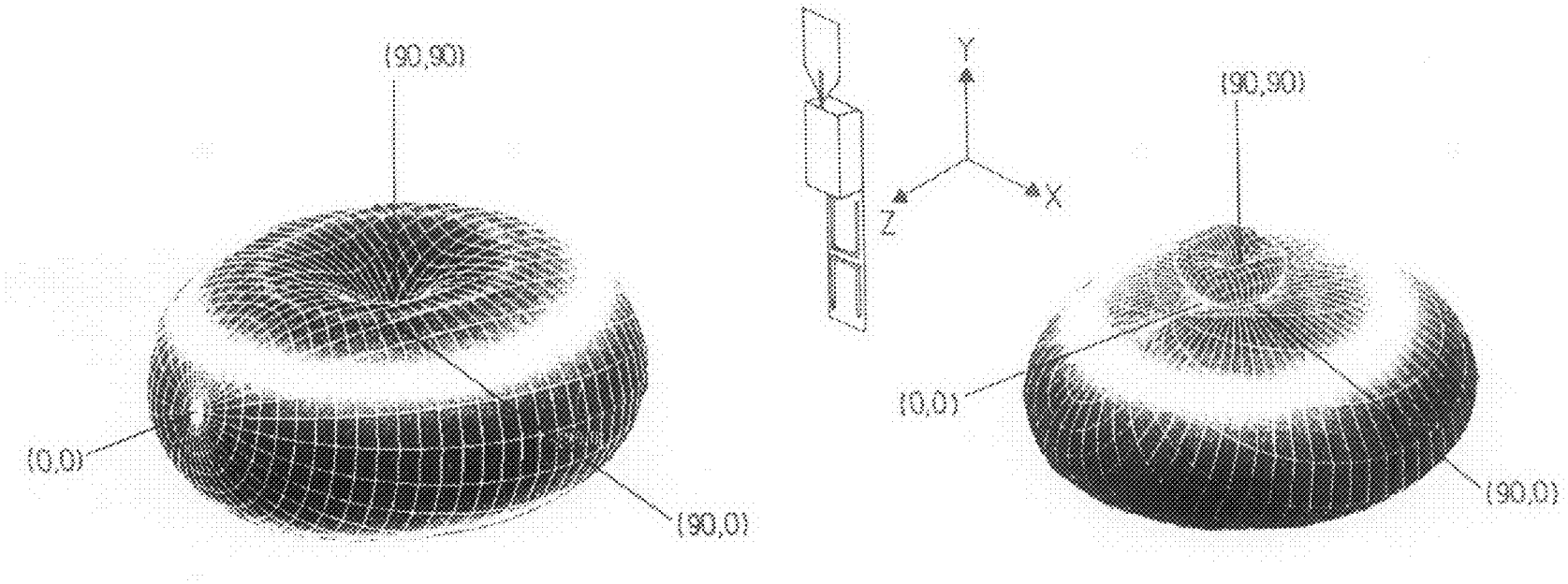
FIG. 8 shows the radiation patterns of the antenna of FIG. 1, respectively at 600 MHz and at 1600 MHz.

FIG. 8 shows the radiation patterns at 600 MHz and at 1600 MHz of the antenna of FIG. 1.

The shape at 600 MHz is typical of a dipole (toroidal) whose null axis corresponds to the longitudinal axis of the antenna.

The shape at 1.6 GHz is both the combination of the diagrams of the two slots as well as the dissymmetry of the structure generated by the position of the slots on the ground plane near a "metal box".

The invention claimed is:

1. Compact multiband antenna, wherein it is constituted by a first dipole type element comprising a first conductive arm connected to a second conductive arm having the shape of a box mounted on a ground plane, the first and the second arms being supplied differentially and a second element of the slot type realized on said ground plane in the extension of said second arm.

2. Antenna according to claim 1, wherein the first and the second arms are mounted in rotation with respect to each other.

3. Antenna according to claim 1, wherein the first arm is of planar form with a tapered part at the level of the connection with the second arm, extending by a rectangular or square part.

4. Antenna according to claim 1, wherein the box is dimensioned to receive an electronic card.

5. Antenna according to claim 1, wherein the dipole type element is connected to an impedance matching circuit.

6. Antenna according to claim 5, wherein the impedance matching circuit performs a filtering function.

7. Antenna according to claim 1, wherein the slot type element comprises two U-shaped slots mounted head to tail.

8. Antenna according to claim 1, wherein it operates in the UHF band or L band with filtering of the GSM band.

* * * * *